United States Patent [19]

Antonious

[11] Patent Number: 4,900,028

[45] Date of Patent: Feb. 13, 1990

[54] IRON TYPE GOLF CLUB HEAD WITH AN INTEGRAL SIGHTING MEANS

[76] Inventor: Anthony J. Antonious, 205 E. Joppa Rd., Towson, Md. 21204

[21] Appl. No.: 95,675

[22] Filed: Sep. 14, 1987

[51] Int. Cl.[4] ..... A63B 69/36; A63B 53/04

[52] U.S. Cl. ..... 273/164; 273/169; 273/183 D; 273/183 E

[58] Field of Search ..... D21/220; 273/164, 183 D, 273/169, 170, 171, 172, 175, 167 F, 167 G, 167 J, 167 K, 183 D, 183 E

[56] References Cited

U.S. PATENT DOCUMENTS

| | | | |
|---|---|---|---|
| D. 165,458 | 12/1951 | Jacobs | D21/220 |
| D. 276,644 | 12/1984 | Solheim | D21/220 |
| 1,441,492 | 1/1923 | Dwight | 273/164 |
| 2,520,950 | 9/1950 | Miller | 273/183 D |
| 2,842,369 | 7/1958 | East | 273/164 |
| 4,222,567 | 9/1980 | Shabala | 273/183 D |
| 4,715,601 | 12/1987 | Lamanna | 273/169 |

FOREIGN PATENT DOCUMENTS

| | | | |
|---|---|---|---|
| 359487 | 10/1931 | United Kingdom | 273/183 D |

*Primary Examiner*—George J. Marlo
*Attorney, Agent, or Firm*—N. J. Aquilino

[57] ABSTRACT

An iron type golf club having an alignment and sighting area formed on the top ridge of the club head proximate the toe and positioned perpendicular to the intended line of flight and parallel to the longitudinal axis of the club face or the grooves on the ball striking face to aid a golfer in aligning the club head square to the intended target line in the address position.

14 Claims, 4 Drawing Sheets

FIG. 9
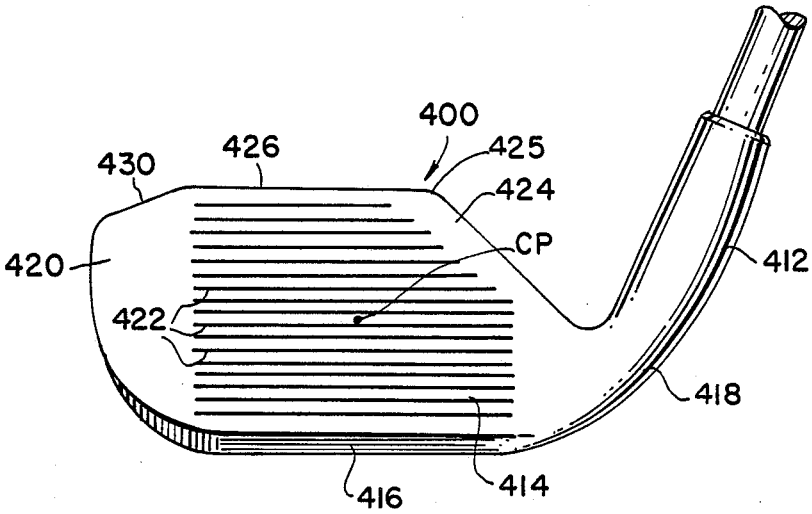
FIG. 11
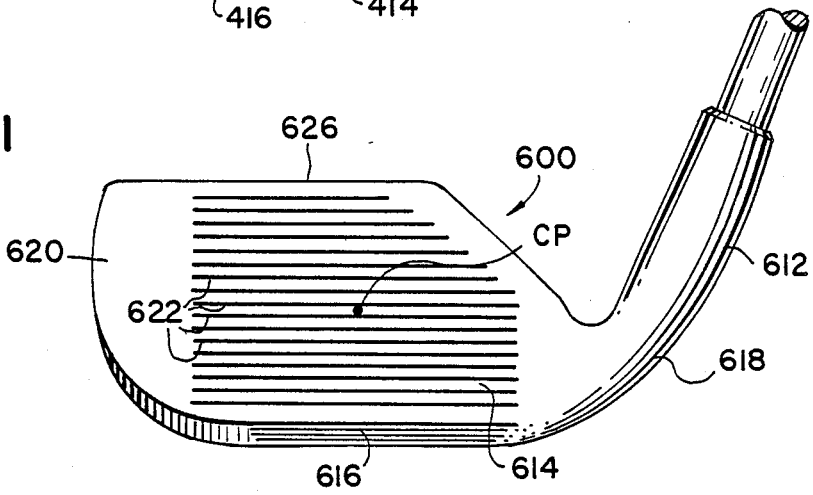
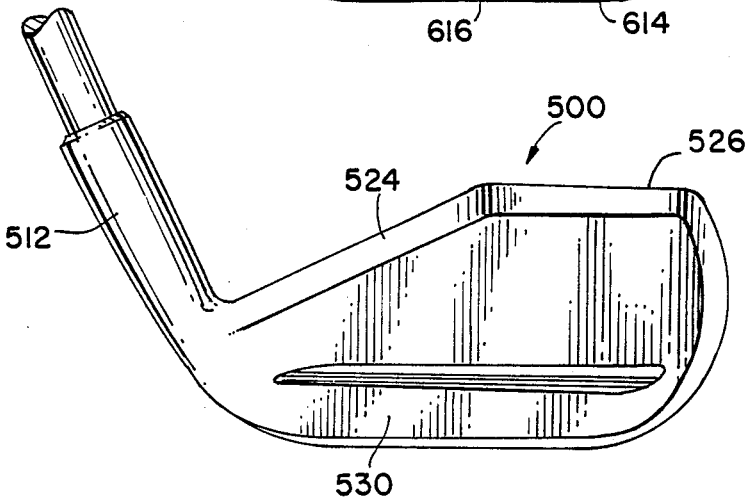
FIG. 10

IRON TYPE GOLF CLUB HEAD WITH AN INTEGRAL SIGHTING MEANS

BACKGROUND OF THE INVENTION

1. Field of the Invention

The present invention relates to iron type golf club heads and, in particular, to an improved iron type golf club head having an alignment and sighting means to aid a golfer in positioning the golf club head in a direction square to the intended target.

2. Description of Prior Art

Iron type golf clubs generally are used to hit a golf ball at a specific target, such as a putting green, and for specific distances. The iron type clubs are designed with various degrees of loft and length in order to control the trajectory and distance of golf ball is hit. Conventional irons range from a minimum of about 16 degrees for a one iron to a maximum of about 60 degrees for a wedge type club. Traditionally, a set of irons will include at least eight to ten clubs each having varying degrees of loft within the above range. As individual clubs in a conventional set of irons become more lofted, the club heads become larger, particularly in the area toward the toe of the club head, and the top or top ridge formed on the top of the club head is formed in a diverging angular direction which generally extends upwardly and outwardly from the hosel toward the toe of the golf club head. This conventional structure has been developed for iron type golf club heads in order to maximize the weighting characteristics of the golf club head and to maximize the ball striking surface on a golf club head. Whereas this type configuration works quite well for these purposes, the outwardly diverging plane of the top edge or top ridge line of the club head tends to be confusing and improper if it is used for alignment purposes. This configuration also results in a club having an uppermost toe portion which is located well above and away from the club's center of percussion. The weight of the club at this uppermost position is believed to minimize effectiveness and may be detrimental to the overall performance of the club.

One patent to Swanson, U.S. Pat. No. 4,345,763 discloses a club with a rectangular club face and a top ridge line extending straight across the entire length of the ball striking face in a direction perpendicular to the intended target line, for alignment purposes. However, that design provides a completely different structure which is non-traditional in shape in weight distribution and strikeability characteristics.

Another patent to Shea U.S. Pat. No. 1,319,802 shows a putter having an elevated horizontal portion 3 which serves as a guide when a player addresses a golf ball.

SUMMARY OF THE INVENTION

The present invention relates to an iron type golf club head which provides the most desirable characteristics of optimum weight distribution and greater ball strikability potential combined with an easy to use sighting or alignment means formed on the uppermost portion of the top ridge of the club head. The alignment means enables a player "at address" to position the club head square to the intended target line.

The golf club head of the present invention includes a sighting section on the upper portion of the top ridge which is perpendicular to the intended target line of flight and is preferably formed parallel to the longitudinal axis between the heel and toe of the club face which is perpendicular to the intended line of flight. This sighting section is located on the upper portion of the top ridge adjacent to and substantially at the upper toe portion of the club head and is substantially parallel to the sole of the club head and therefore substantially horizontal to the ground when the club head is addressed to the ball.

The design of the club head of the present invention redistributes the weight which would normally be adjacent the upper toe portion of a golf club and repositions it closer to the center of percussion. This weight distribution provides improved control and feel.

The sighting section is formed as an integral part of the club head to enhance the squareness thereof when addressing the ball. The sighting section aids in aligning the eyes toward the intended target and facilitates a ninety degree alignment position or a square club head position to the intended target or direction by providing an optimum focal point on the club head. The sighting section is located on the uppermost portion of the club head and provides the golfer with an unobstructed sighting and alignment means that is always visible, notwithstanding the location of the sole of the club head which at times may not be seen as, for example, if it lies in heavy or tall grass.

In the preferred embodiments, the "square" portion of the top ridge of the club head which forms the sighting area would extend approximately one-third to two-thirds of the distance across the ball striking face of the club head. It is also contemplated that the sighting and alignment means may be combined with an arrow, lines or other suitable indicia formed on the face of the club head to further enhance the ability of the golfer to squarely align the club head at the target. Such an arrow, lines or other indicia would be perpendicular to the "square" portion of the top ridge and would therefore generally indicate the intended line of flight.

Among the objects of the present invention are the provision of an iron type golf club head having improved weighting and ball striking characteristics in combination with an alignment and sighting means on an upper portion of the top ridge of the club head to enhance the ability of a player to properly and easily align the club head with the intended target line.

Another object is to provide a club head having alignment indicia on both the top ridge and the face of the club head.

Other objects and advantages of the invention will be set forth in part in the description which follows, and in part will be obvious from the description, or may be learned by the practice of the invention. The objects and advantages will be realized and attained by means of the elements and combinations particularly pointed out in the appended claims.

The accompanying drawings, which are incorporated in and constitute a part of this specification, illustrate several embodiments of the invention and, together with the description, serve to explain the principles of the invention.

DESCRIPTION OF THE DRAWINGS

FIG. 9 is a front elevational view of a fifth embodiment of the present invention.

FIG. 10 is a front elevational view of the present invention on a forged type golf club head.

FIG. 11 is a front elevational view of a sixth embodiment of the present invention.

DESCRIPTION OF THE PREFERRED EMBODIMENT

Figure 1:
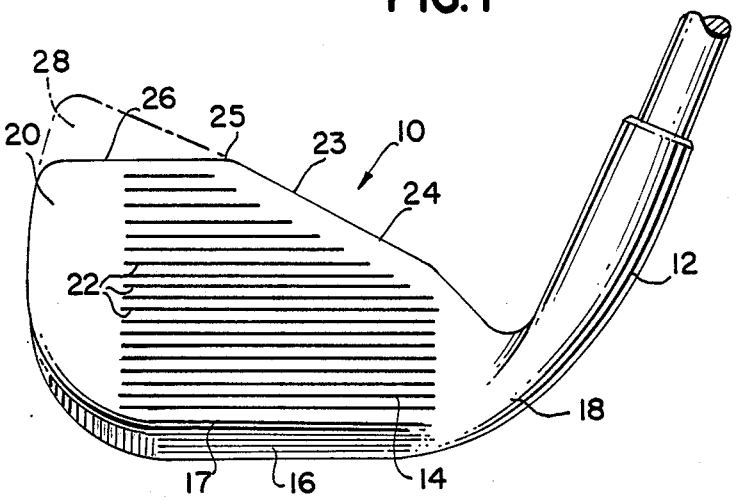
FIG. 1 is a front elevational view of a first embodiment of the present invention on a cast type golf club head.
Figure 3:
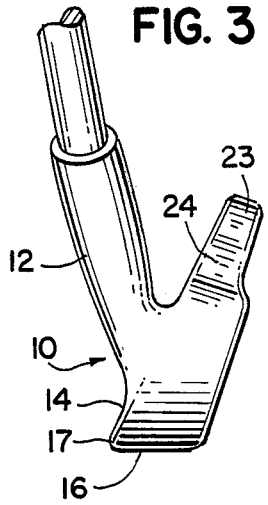
FIG. 3 is a side elevational view of FIG. 1.

Reference will now be made in detail to the present preferred embodiments of the invention, examples of which are illustrated in the accompanying drawings. Wherever possible, the same reference numbers will be used throughout the drawings to refer to the same or like parts.

The drawings illustrate a conventional cast type iron golf club head 10 having a loft angle within the range of approximately 16 degrees to 60 degrees which is perimeter weighted and has a cavity back. The club head includes a hosel 12, ball striking face 14, sole 16, heel 18 and toe 20. The ball striking face 14 encompasses the area on the front of the club head which is designed to impact the ball and hit the ball on an intended line of flight perpendicular to the club face. The ball striking face 14 shown in FIG. 1 includes a plurality of grooves 22 of conventional design which, when viewed by a golfer, are perpendicular to the normal intended line of flight. These grooves 22 may be, but are not necessarily, parallel to a portion of the front bottom edge 17 of the striking face. Although the grooves shown in the drawings are preferably parallel, the present invention can be applied to clubs having other club face markings such as diamond or circular shaped indentations, or other random or irregularly spaced grooves formed in the club face. As described below, however, the disclosed parallel grooves are preferred because they can be used in combination with the top ridge alignment feature of the present invention.

The club head includes a top ridge 23 having a first portion 24 adjacent the heel 18 which diverges and extends upwardly and outwardly from the heel 18 toward the toe 20 to a point 25 where it changes direction and forms a second straight sighting section 26 which extends substantially horizontally and perpendicular to the intended line of flight. This second portion 26 of the top ridge 23 serves as an alignment and sighting means of the present invention. As shown in FIG. 1, the design of the present invention eliminates the wasted weight at the uppermost top of the toe found in conventional clubs, that wasted weight being illustrated by the area 28 shown in phantom.

Figure 4:
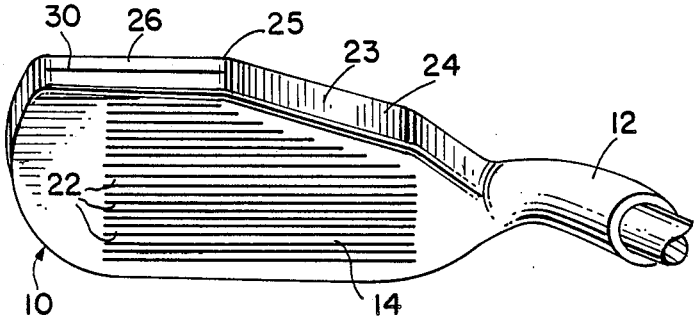
FIG. 4 is a top plan view of FIG. 1.

The straight sighting section 26 on the upper portion of the top ridge 23 continues in a longitudinal direction from the point 25, where it meets the first portion 24, toward the toe 20 of the club head. The sighting section 26, as shown in FIG. 4, is a flat area located above the ball striking face 14 and extending from the toe 20 to the point 25 located partway across the width and above the ball striking face. As shown, point 25 is spaced a substantial distance from the hosel 12, and in the embodiment shown in FIGS. 1–4 has a length equal to approximately one-third to one-half of the length of the top ridge 23. The preferred sighting section 26 has a thickness, as shown in FIG. 4, although it could be in the form of a straight edge formed by the intersection of the back and front faces of the club. The upper surface of the sighting section 26 is preferably flat and parallel to the sole 16 at the bottom of the club head 10 and is in the same direction as the grooves 22 on the ball striking face 14 so that the sighting section 26 is parallel to the ground and perpendicular to the intended line of flight when a golfer aligns the club with the ball.

As shown in FIG. 4, the club head can further include an alignment indicia 30 formed as a line along the longitudinal axis of the sighting section 26 as shown. It will be appreciated that the indicia may take the form of a groove formed in the sighting area or any other suitable marking means. The alignment indicia 30 is parallel to the grooves 22 on the ball striking face 14 and further serves to visually aid a golfer in positioning the club head "square" to the intended target line.

Figure 2:
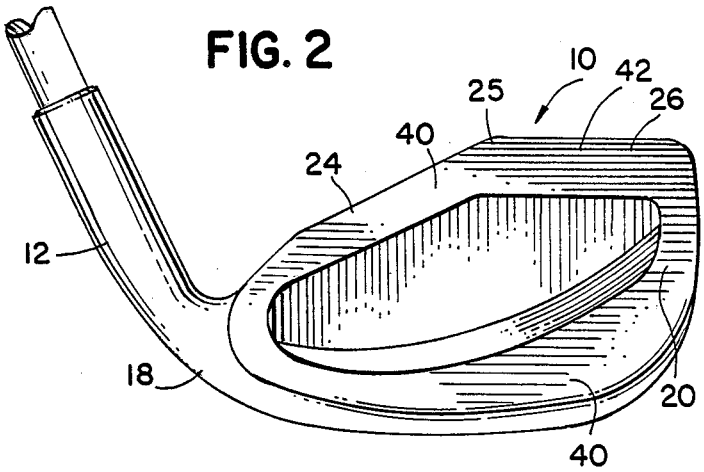
FIG. 2 is a rear elevational view of FIG. 1.

As shown in FIG. 2 which illustrates the rear face of the golf club head 10, the present invention in the preferred embodiment includes perimeter weight member 40. The sighting section 26 relocates a section 42 of the perimeter weight member 40 to a lower position closer to the center of percussion under the sighting section 26 thereby moving the overall perimeter weight lower and closer to the center of percussion. Therefore, the "wasted weight" in the uppermost toe portion 28 of a conventional golf club moves to a location closer to the ball striking area and this improved distribution of weight provides increased feel and control when executing a golf shot.

In use, when the club head 10 is placed behind the ball, the position of the club head 10 is adjusted until the sighting section 26 is perceived to be perpendicular or "square" to the intended target line. Because of the "straight-line" configuration of the sighting section 26, adjusting the club head to the proper position is relatively simple in optical terms as compared to conventional golf clubs which have top ridge lines which diverge in an upward and outward direction all the way between the toe and heel of the club head. Once the sighting area 26 is perceived to be square to the target line, the golfer may initiate a back swing, assured that the club head has been started from the proper "address" position. This alignment feature thereby eliminates any necessity of making further adjustments during the golf swing itself.

Typically, the iron type golf head of the present invention from toe to heel would be approximately three inches long and the sighting area would be at least approximately one inch or longer depending upon the shape, height and length of the club head.

Figure 5:
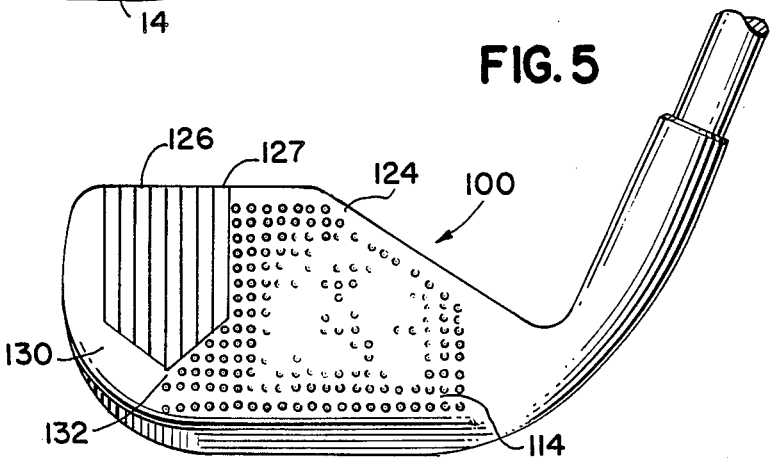
FIG. 5 is a front elevational view of a second embodiment of the present invention.

FIG. 5 illustrates a second embodiment of a golf club head 100 of the present invention having essentially the same characteristics as the club head 10 described hereinabove. In this embodiment, the club face 114 is provided with a series of indentations in place of the grooves shown in the embodiment described above. The club head 100 includes a sighting section 126 as described hereinabove to align the club head "square" to the target line. The embodiment further includes alignment indicia shown in the form of a directional arrow 130, located on the ball striking face 114 and positioned below the sighting section 126. The lower portion of the alignment indicia 130 terminates in a point 132 on the striking face 114 positioned approximately below the middle of the sighting portion 126. The directional arrow 130 has a width extending from a location adjacent the toe 120 to a second location adjacent a point 127 on the horizontal sighting section 126 between the toe 120 and the point 125 where the sighting section meets the diverging portion 124 of the top ridge 123. The lower portion of the alignment indicia 130 terminates at a point 132 on the striking face positioned approximately below the middle of the sighting portion 126. When the club head is properly aligned "square" to the target line, the alignment indicia arrow 130 points directly to the target.

Figure 6:
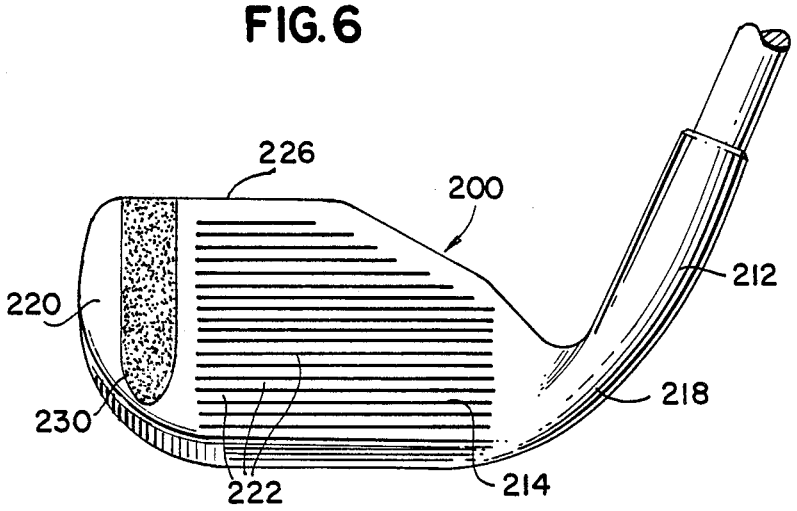
FIG. 6 is a front elevational view of a third embodiment of the present invention.

FIG. 6 illustrates another embodiment of an iron type golf club head 200 of the present invention which also is essentially the same as the club head 10 described with respect to FIGS. 1 through 4. In this embodiment, the club head 200 includes a sighting section 226 which extends from the upper portion of the top ridge 224 of the club head 200 and further includes alignment indicia 230 located between the toe 220 and the grooves 222 on the ball striking face 214 of the club head 200.

In both the embodiments of FIGS. 5 and 6, the suitable alignment indicia are used to further aid the golfer to position the club head "square" to the target line. It becomes a matter of personal preference as to whether a golfer would prefer to have a wide alignment indicia extending into the ball striking face or narrower indicia positioned only on the toe portion of the club head.

Figure 7:
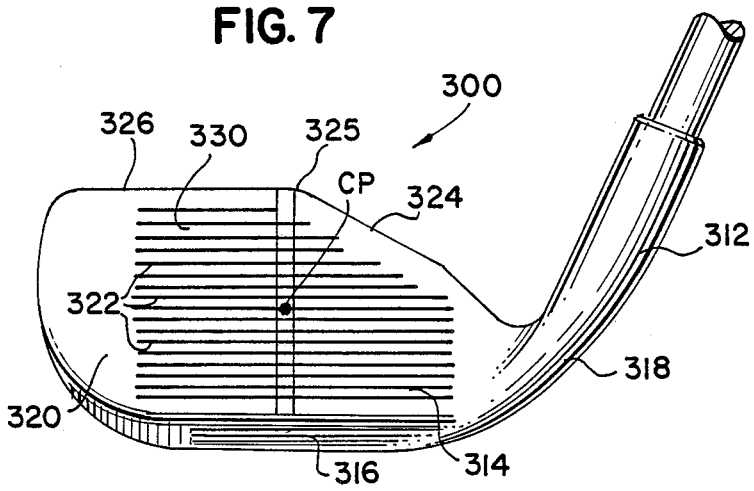
FIG. 7 is a front elevational view of a fourth embodiment of the present invention.
Figure 8:
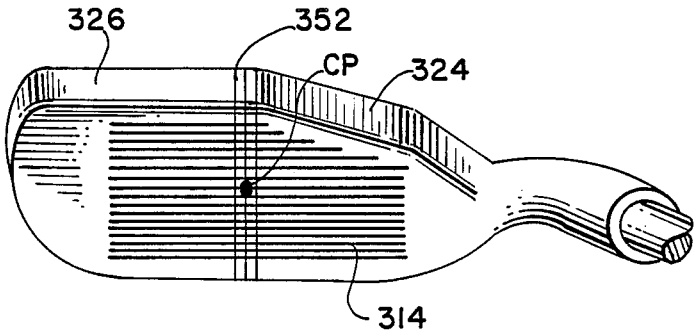
FIG. 8 is a top plan view of FIG. 7.
Figure 12A:
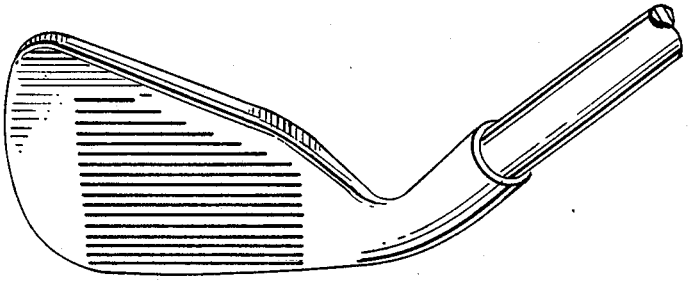
FIG. 12*a* is a front elevational view of a conventional golf club.
Figure 12B:
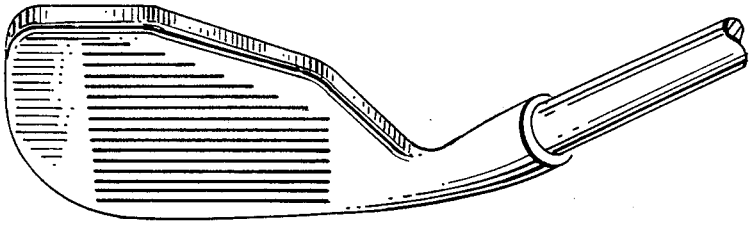
FIG. 12*b* is a front elevational view of a golf club according to the present invention.
Figure 14A:
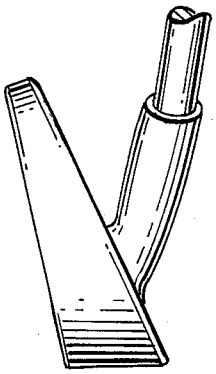
FIG. 14*a* is an end view of a conventional golf club.
Figure 13A:
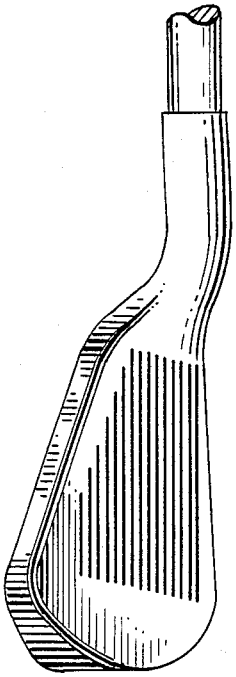
FIG. 13*a* is a top view of a conventional golf club.
Figure 13B:
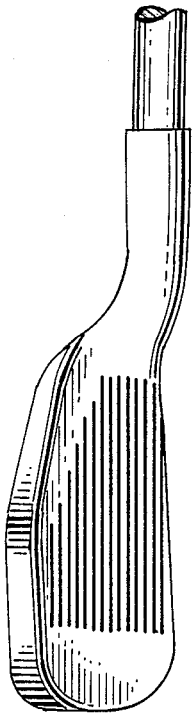
FIG. 13*b* is a top view of a golf club according to the present invention.
Figure 14B:
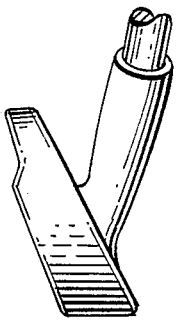
FIG. 14*b* is an end view of a golf club according to the present invention.

FIGS. 7 and 8 illustrate still another embodiment of an iron type golf club head 300 of the present invention which is the same type as described hereinabove. In this embodiment, the club head 300 includes a sighting section 326 which extends to a point 325 positioned directly over the center of percussion (CP) of the club head 300. The sighting section 326 is formed on the upper portion of the top ridge 324 from upper toe 320 to a point 325 of the club head 300 and is parallel to and extends partway above the grooves 322 on the ball striking face 314. As shown in FIG. 8, sight lines 352 are formed on the sighting section 326 and extend downwardly across the ball striking face 314 through the center of percussion CP. These sight lines are parallel with the intended line of flight. The lines, therefore, allow a golfer to place the ball directly at the center of percussion. The golfer can then properly align the club head by utilizing the sighting section 326 at the uppermost portion on the club face. As a result, the golfer using the club can visually align the ball with the center of percussion to obtain maximum power and control.

FIG. 9 illustrates still another embodiment of an iron type golf club head 400 of the present invention which is a similar type as described hereinabove. In this embodiment, the club head 400 includes a sighting section 426 which extends to a point 425 located approximately two-thirds of the distance between the toe 420 and heel 418 of the club head 400. The top ridge 424 of the club head 400 includes a section 430 located at the toe 420 which tapers downwardly as shown. With this structure, the sighting section 426 is centrally located on the top ridge 424 of the club head approximately above the center of percussion CP on the club face 414 thereby providing greater ease for a golfer to focus on both the sighting section and the center of percussion to aid the golfer in aligning the club head 400 perpendicular to the target line.

FIG. 10 illustrates a forged type golf club head 500 having a sighting section 526. It will be appreciated that any of the embodiments described with reference to FIGS. 1–8 and shown in the drawings on cast type, perimeter weighted golf club heads, are equally applicable to forged type golf club heads of the type shown in FIG. 10.

FIG. 11 illustrates an embodiment of an iron type golf club head 600 of the present invention which is similar to the embodiment of FIG. 9. A sighting section 626 extends from adjacent the toe 620 approximately two thirds of the distance along the top ridge 626 toward the heel 618 of the club head.

FIGS. 12*a*, 12*b*, 13*a*, 13*b*, 14*a*, and 14*b* are comparative views of conventional golf club heads and golf club heads made in accordance with the present invention taken from the front, top and end of the clubs.

It will be appreciated that various changes may be made in the club head design described above without departing from the scope of the present invention as defined in the following claims.

I claim:

1. An iron type golf club head comprising:

a main body including a heel, a hosel proximate said heel, a toe, a rear surface, an upper surface, a lower surface including a sole, a ball striking face to hit the ball along an intended line of flight, a center of percussion, and a top ridge extending from the hosel to the toe, said top ridge being characterized by a first section extending upwardly and outwardly from said hosel toward said toe at an angle and a second section extending in a straight line in the heel to toe direction from a first point adjacent said toe to a second point located substantially remote from said toe between said toe and said hosel and substantially spaced from said hosel, said second section forming a sighting and aligning means to facilitate proper alignment of the club head to the intended line of flight, and a rearward projecting peripheral weighting moss located on said rear surface of said club head defining a cavity therein generally coextensive in length with said first and second section and being further characterized by providing substantial peripheral weight located adjacent said toe, said heel and said lower surface of said club head, and also adjacent generally parallel to, and below said first and second sections.

2. The golf club head of claim 1 further comprising a sighting line formed on the top surface of said second straight section along substantially its entire length, said line being perpendicular to the intended line of flight.

3. The golf club head of claim 1 further characterized by a loft angle of at least 16 degrees.

4. The golf club head of claim 1 further comprising a plurality of linear grooves formed in the face of the club head.

5. The golf club head of claim 4 wherein said second straight section and said grooves are parallel to each other.

6. The golf club head of claim 1 wherein said second straight section extends approximately one-third of the distance between said toe and said heel.

7. The golf club head of claims 1, 2, 3 or 5 further including alignment indicia means on said face of said golf club head for cooperating with said sighting and alignment means to further facilitate the proper alignment of the club head.

8. The golf club head of claim 7 wherein said alignment indicia is positioned adjacent to and below said second straight section and points in a direction perpendicular to said second straight section.

9. The golf club head of claim 8 wherein said alignment indicia includes a point which in cooperation with said straight section provides a visual indication of the direction of the intended flight.

10. The golf club head of claim 8 wherein said alignment indicia includes two or more indicia lines forming an arrow and further comprising two upper sight lines formed on the top surface of said second straight section, parallel with the line of intended flight, and aligned with the uppermost portion of said indicia lines.

11. An golf club head of claim 8 wherein said alignment indicia is positioned adjacent the toe of said golf club head.

12. The golf club head of claims 1, 2, 3 or 5 wherein said second straight section is located directly over the center of percussion of the club head.

13. The golf club head of claims 1, 2, 3 or 5 wherein said second straight section extends up to approximately two thirds of the distance between said toe and said heel.

14. The golf club head of claims 1, 2, 3 or 5 wherein said straight section of said sighting and aligning means is further characterized by a flat surface parallel to the sole of said golf club head.

* * * * *